US008382347B2

(12) United States Patent
McCanless

(10) Patent No.: US 8,382,347 B2
(45) Date of Patent: Feb. 26, 2013

(54) LIGHT FIXTURE

(75) Inventor: Forrest S. McCanless, Oxford, GA (US)

(73) Assignee: ABL IP Holding LLC, Conyers, GA (US)

( * ) Notice: Subject to any disclaimer, the term of this patent is extended or adjusted under 35 U.S.C. 154(b) by 566 days.

(21) Appl. No.: 12/649,639

(22) Filed: Dec. 30, 2009

(65) Prior Publication Data

US 2010/0254134 A1 Oct. 7, 2010

Related U.S. Application Data

(60) Provisional application No. 61/211,725, filed on Apr. 2, 2009.

(51) Int. Cl.
*F21S 13/10* (2006.01)
*F21S 13/12* (2006.01)
*F21S 13/00* (2006.01)

(52) U.S. Cl. ..... 362/431; 362/249.02; 362/294; 362/367; 362/410

(58) Field of Classification Search ..... 632/431; 362/249.02, 294, 367, 410, 431
See application file for complete search history.

(56) References Cited

U.S. PATENT DOCUMENTS

| | | | | |
|---|---|---|---|---|
| 6,328,457 | B1 | 12/2001 | Huang | |
| 6,776,508 | B2 | 8/2004 | Bucher et al. | |
| 6,784,357 | B1 * | 8/2004 | Wang | 362/431 |
| 6,871,985 | B2 | 3/2005 | Humphrey | |
| D537,556 | S * | 2/2007 | Summerford et al. | D26/142 |
| 7,204,618 | B1 | 4/2007 | Kuelbs et al. | |
| 7,241,023 | B1 | 7/2007 | Carpenter | |
| 7,278,761 | B2 | 10/2007 | Kuan | |
| 7,420,811 | B2 | 9/2008 | Chan | |
| 7,488,093 | B1 | 2/2009 | Huang et al. | |
| 7,665,866 | B2 * | 2/2010 | Mayer et al. | 362/297 |
| 7,682,049 | B2 * | 3/2010 | Zheng et al. | 362/294 |
| 7,828,461 | B2 * | 11/2010 | Mayer et al. | 362/241 |
| 7,841,734 | B2 * | 11/2010 | Wilcox | 362/153 |
| 7,914,182 | B2 * | 3/2011 | Mrakovich et al. | 362/373 |
| 8,021,027 | B2 * | 9/2011 | Galipeau et al. | 362/431 |
| 8,157,413 | B2 * | 4/2012 | Maxik et al. | 362/244 |
| 2005/0146874 | A1 | 7/2005 | Cech et al. | |
| 2006/0044789 | A1 | 3/2006 | Curtis | |
| 2006/0092638 | A1 | 5/2006 | Harwood | |
| 2006/0105485 | A1 | 5/2006 | Basin et al. | |
| 2006/0109647 | A1 | 5/2006 | Liu | |
| 2006/0250803 | A1 | 11/2006 | Chen | |

(Continued)

FOREIGN PATENT DOCUMENTS

WO WO-2009145883 12/2009

OTHER PUBLICATIONS

Non-Final Office Action issued Feb. 15, 2011 in related Canadian Application No. 2,689,403 entitled "tight Fixture": 2 pages.

*Primary Examiner* — Mariceli Santiago
(74) *Attorney, Agent, or Firm* — Kilpatrick Townsend & Stockton LLP

(57) ABSTRACT

Light fixtures having a plurality of light-emitting diodes that maximize the amount of direct light into an intended area. The light fixture may include a carriage with a first (top) end and a second (bottom) end. A hood may be mounted to the first end of the carriage. At least one light engine comprising a plurality of light sources is mounted to the hood. The light sources emit light downwardly directly onto an intended area. In certain embodiments the second end of the carriage is shaped and sized so that it does not interfere with emission of the light to the intended area. The light fixture thus provides light in a thermally efficient manner, maximizes the amount of direct light, and limits the amount of light pollution.

17 Claims, 8 Drawing Sheets

U.S. PATENT DOCUMENTS

| | | | | |
|---|---|---|---|---|
| 2006/0285310 | A1 | 12/2006 | Shyu | |
| 2006/0291218 | A1 | 12/2006 | Pazula | |
| 2007/0159819 | A1 | 7/2007 | Bayat et al. | |
| 2007/0201228 | A1 | 8/2007 | Young | |
| 2007/0242451 | A1 | 10/2007 | Richmond | |
| 2008/0031013 | A1 | 2/2008 | Ruggles et al. | |
| 2008/0062689 | A1 | 3/2008 | Villard | |
| 2008/0062691 | A1 | 3/2008 | Villard et al. | |
| 2008/0074867 | A1 | 3/2008 | Chen | |
| 2008/0089070 | A1 | 4/2008 | Wang | |
| 2008/0218992 | A1 | 9/2008 | Li | |
| 2008/0232094 | A1 | 9/2008 | Ramsdell | |
| 2009/0073681 | A1 | 3/2009 | Chen | |
| 2009/0237934 | A1* | 9/2009 | Zeng et al. | 362/249.03 |

* cited by examiner

LIGHT FIXTURE

CROSS-REFERENCE TO RELATED APPLICATIONS

This application claims to the benefit of Application Ser. No. 61/211,725, filed on Apr. 2, 2009 and entitled "Light Fixture," the entire contents of which are incorporated by reference.

FIELD OF THE INVENTION

Embodiments of the present invention relate to light fixtures using direct light.

BACKGROUND OF THE INVENTION

Energy efficiency and environmental impact have become areas of great concern for society. Thus, many cities have adopted "Dark Skies" initiatives that aim to reduce light pollution by encouraging reduced amounts of light in the nocturnal environment. These initiatives encourage using less light in general, using controls (such as on-off capabilities and time-of-night sensors), and using reflectors and shields to reduce nocturnal light. Such measures may result in energy savings resulting in economic benefits, better nighttime ambience and quality of life, conservation of nocturnal wildlife and ecosystems, and increased visibility at night by reducing glare. One organization that supports such initiatives is the International Dark Sky Association.

In keeping with these initiatives, commercial entities and concerned individuals continue to look for ways to reduce their energy consumption and the amount of light that is emitted upward into the sky. Many individuals are looking to replace old light fixtures with newer fixtures or at least to modify existing light fixtures to be more efficient. The concern is generally found in light fixtures that are employed in outdoor settings, such as street or post top fixtures, but is equally applicable to indoor light fixtures.

An existing post top fixture 10 is shown in FIG. 1. This post top fixture 10 uses a mixture of indirect and direct lighting, and is not necessarily compliant with Dark Skies initiatives. Nor is it very thermally or energy efficient. The post top fixture 10 has a carriage 20 defined by side arms 24 and clear, diffuse or prismatic glass or plastic panes 26 positioned between the side arms 24. There is a hood 16 affixed to the top of the carriage 20. The hood 16 has a cavity 14 that is dimensioned to receive a light source 12. The light sources 12 in such traditional post top fixtures 10 are typically compact fluorescent, high intensity discharge or incandescent light bulbs. In use, it is generally intended for the light to be emitted downwardly from the hood 16, in the area around the pole of the fixture 10. This area is called the "intended area" for the emitted light.

Some of the light is emitted towards the intended areas, resulting in direct lighting of the intended area. The direct light must pass through the panes 26 that define the carriage 20. When light passes through the panes 26, it can result in a loss of optical efficiency of around 8%. The tilted panes 26 may also refract light upwards into the sky. If the panes 26 are dirty then optical efficiency and upward refraction and reflection are even more problematic. Additionally, the panes 26 if constructed of glass or brittle plastic are subject to vandalism by people breaking the panes 26. The panes 26 thus result in inefficiency and might create dangerous conditions.

Additionally, some of the light in traditional post top fixtures 10 is emitted upwardly, which wastes energy and violates Dark Skies initiatives. Thus, a reflector 18 may be placed around the cavity 14 and on the underside of the hood 16 to redirect some of the upwardly emitted light back downward into the intended area, thus resulting in indirect lighting of the intended area. While the reflector 18 does tend to minimize the amount of emitted light that is directed upward, it does not eliminate it entirely as a portion of the refracted light traveling through the panes 26 will be redirected upwards.

Commercial entities and concerned individuals may desire to replace these existing post top fixtures 10 with new light fixtures that are more efficient and are in keeping with Dark Skies initiatives. But the cost of completely replacing existing post top fixtures 10 might be prohibitive, and results in landfill waste. Thus, it may be desirable to modify existing post top fixtures 10 to be more efficient and Dark Skies friendly.

Therefore, there is a need for an efficient light fixture that maximizes the amount of direct lighting supplied to an intended area.

There is also a need for a light fixture that minimizes the amount of upwardly directed light, thus minimizing energy loss and light pollution.

There is also a need to modify existing light fixtures to be more efficient and Dark Skies friendly, rather than replacing the existing light fixtures with new light fixtures.

SUMMARY OF THE INVENTION

Certain embodiments of the present invention provide a light fixture (including but not limited to an outdoor light fixture) that maximizes the amount of direct lighting into an intended area by using light engines with light sources that emit light directly towards the intended area. Also, the light fixture may be structurally configured to avoid obstruction of the emitted light but rather to ensure that the most light possible reaches the intended area. The light fixture may include a carriage with a first (top) end and a second (bottom) end opposite the first end. A hood may be mounted to the first end of the carriage. At least one light engine may be mounted to the hood. The light engine includes a plurality of light sources that emit light downwardly directly onto an intended area. In some embodiments, the light sources are light-emitting diodes. It may be desirable from a heat transfer and thermal efficiency perspective to mount the light engine(s) onto a mounting plate, which is subsequently mounted to the hood such that the light engines are in close proximity to the hood surface thus minimizing the thermal path for heat from the light engines to travel to the hood surface where it will be radiated and conducted off. Regardless, the light sources are preferably positioned on the light engines and the light engines preferably positioned on the hood so that light emitted from the light sources has an unobstructed path to the intended area. It is preferable, but not required, that the second end of the carriage be shaped and sized so that it does not interfere with emission of the light to the intended area. The light fixture thus provides light in a thermally efficient manner, maximizes the amount of direct light, and limits the amount of light pollution.

DETAILED DESCRIPTION

Figure 1:
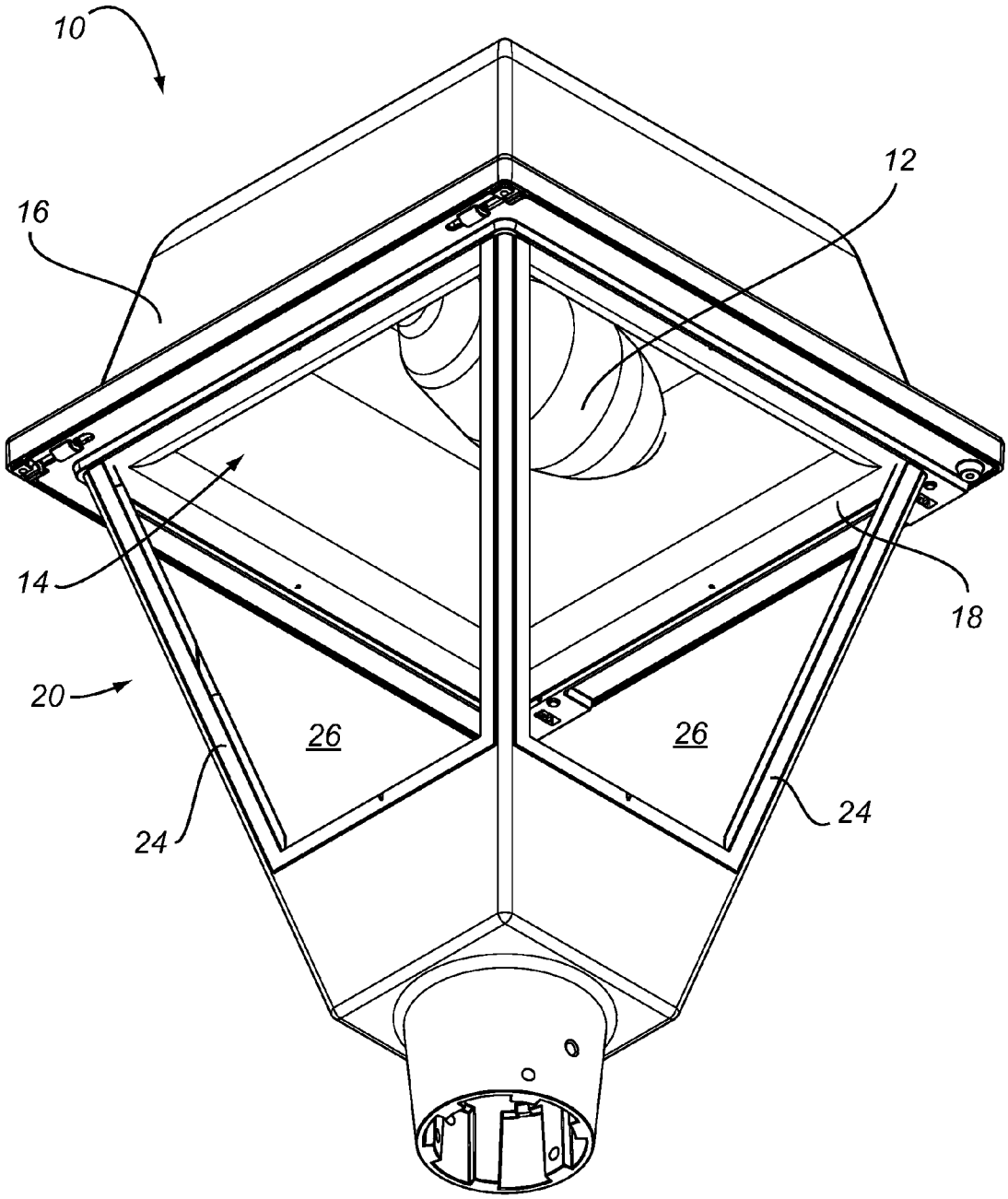
FIG. 1 (Prior Art)
FIG. 1 is a bottom isometric view of a prior art post top fixture.
Figure 2:
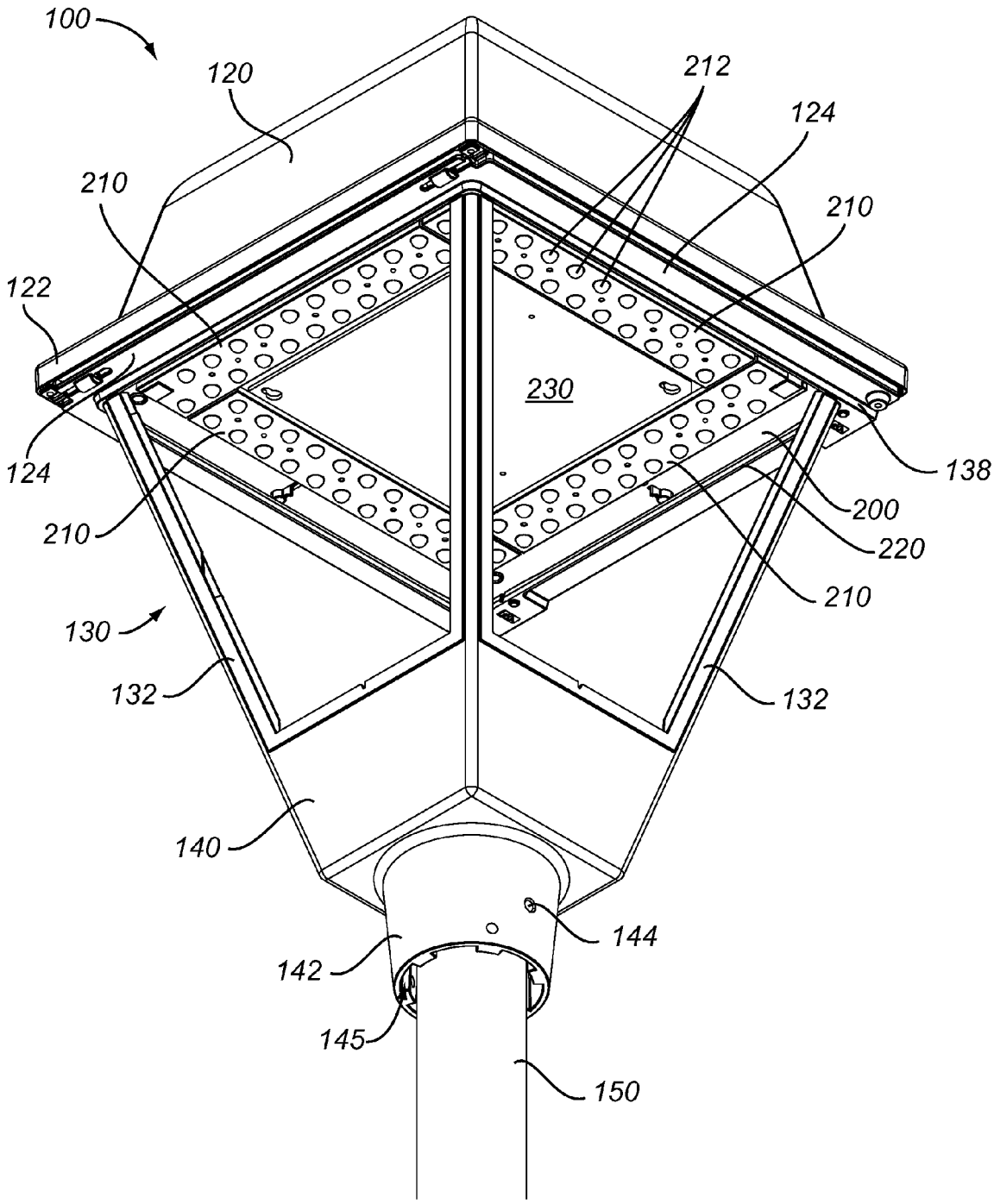
FIG. 2 is a bottom isometric view of a light fixture according to one embodiment of this invention.

One embodiment of the light fixture 100 is shown in FIG. 2. Embodiments of the light fixture 100 may either be modified versions of existing post top fixtures 10 (as shown in FIG. 1), or they may be newly constructed light fixtures 100. One of skill in the art would understand how to modify an existing post top fixture 10 to create the light fixture 100 described herein.

One embodiment of a light fixture 100 may include a carriage 130 that has a first (top) end 138 and a second (bottom) end 140. Side arms 132 extend between the first end 138 and the second end 140, and the side arms 132 are connected by edges 124. While panes may be used, in certain embodiments there are no panes between the side arms 132 so that the space between the side arms 132 is open. Such embodiments might be useful to increase the optical efficiency of the light fixture 100 (because panes may result in a loss of optical efficiency of around 8%) and to minimize any upward refraction or reflection caused by the panes. Although the embodiments of the carriage 130 shown in the figures have a square cross-section (thus, four side arms 132), it should be understood that the shape of the carriage 130 is in no way limited to the shape shown in the figures. Rather, a carriage 130 of any shape or configuration may be used.

Figure 7:
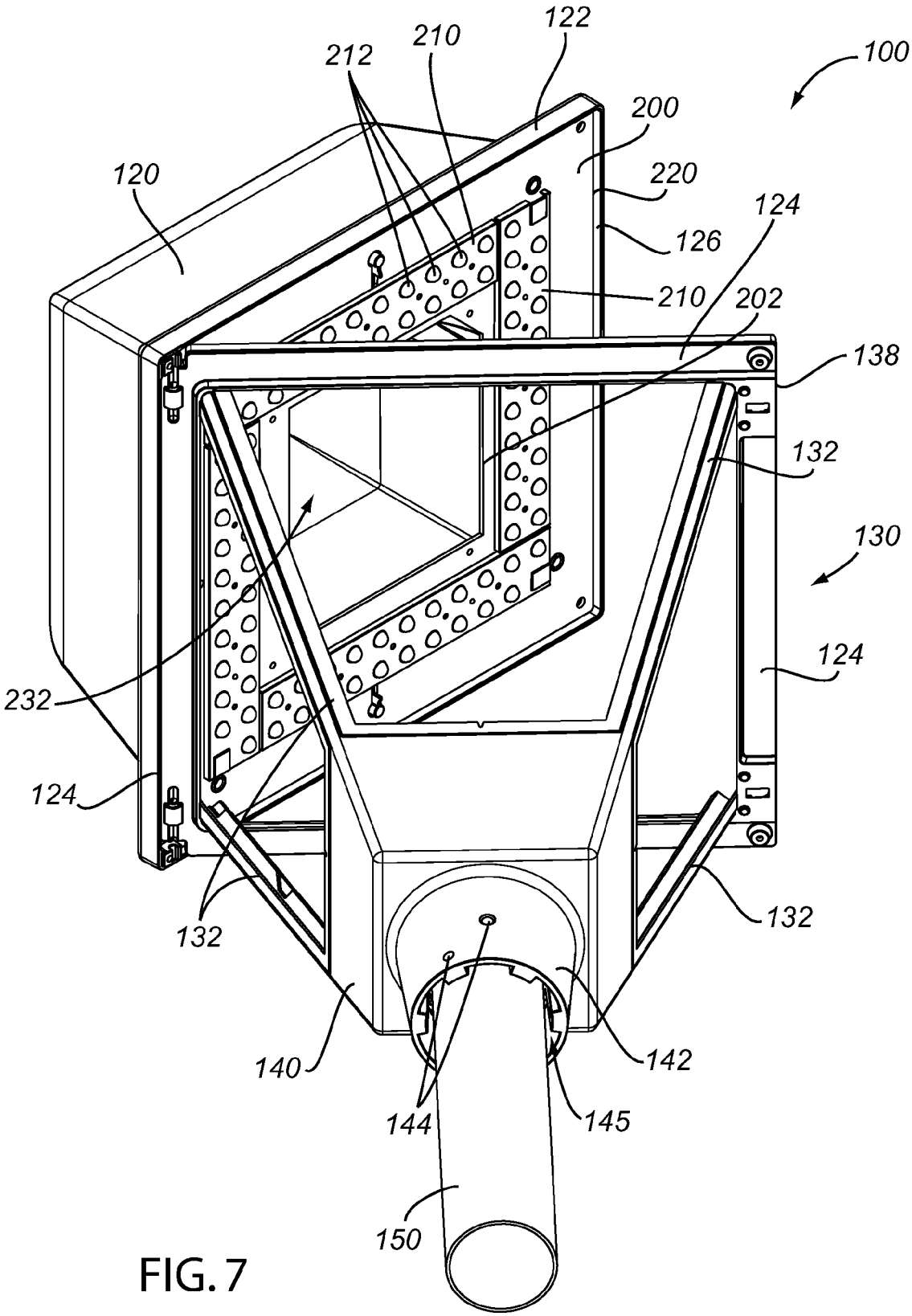
FIG. 7 is a bottom isometric view of the light fixture shown in FIG. 2, with the hood open and the access panel removed.

In certain embodiments the light fixture 100 also includes a hood 120 coupled to the first end 138 of the carriage 130. It may be desirable for the hood 120 to be opened or removed in order to access inside the carriage 130. Thus, in some embodiments, the hood 120 may be hinged to an edge 124 of the carriage 130 to allow the hood 120 to be opened (such as shown in FIG. 7). In other embodiments, the hood 120 may be coupled to the carriage 130 with removable fasteners (such as screws or bolts) that allow the hood 120 to be removed. But it should be understood that it is not necessary to remove the hood 120, and thus the bottom portion 122 may be coupled to the carriage 130 with more permanent retention means, such as via adhesive, welding, or other techniques. It should also be understood that the shape of the hood 120 is in no way limited to the rectilinear configuration shown in the figures.

The carriage 130 also includes a pole-receiving portion 142 proximate the second end 140 for mounting the light fixture 100 to a pole 150. In FIGS. 2 and 7, the pole-receiving portion 142 is a cuff provided with a mounting aperture 145 that is dimensioned to receive the pole 150, and may also optionally include a plurality of apertures 144 to receive fasteners (not shown) to secure the pole 150 to the pole-receiving portion 142. The pole-receiving portion 142 may be integrally-formed with the carriage 130 or may be separate from, but mated to, the carriage 130. The mounting aperture 145 may be of any shape that permits the pole 150 to be inserted into the mounting aperture 145. Also, the second end 140 of the carriage 130 may be dimensioned and positioned to maximize the amount of direct light. For example (and as discussed more thoroughly below), the second end 140 may have a smaller cross-sectional area than the first end 138 of the carriage 130 and the hood 120, and may be aligned with the center of hood 120.

The structural elements of the light fixture 100—including the hood 120, carriage 130, and pole-receiving portion 142—may be made with a variety of materials, including metals (such as stainless steel or aluminum), or plastics. One of skill in the art would recognize that the elements of the light fixture 100 may be made with any suitable manufacturing technique. Alternatively, and as described in more detail herein, one of ordinary skill in the art would understand how to modify an existing post top fixture 10 to create the light fixture 100.

Figure 3:
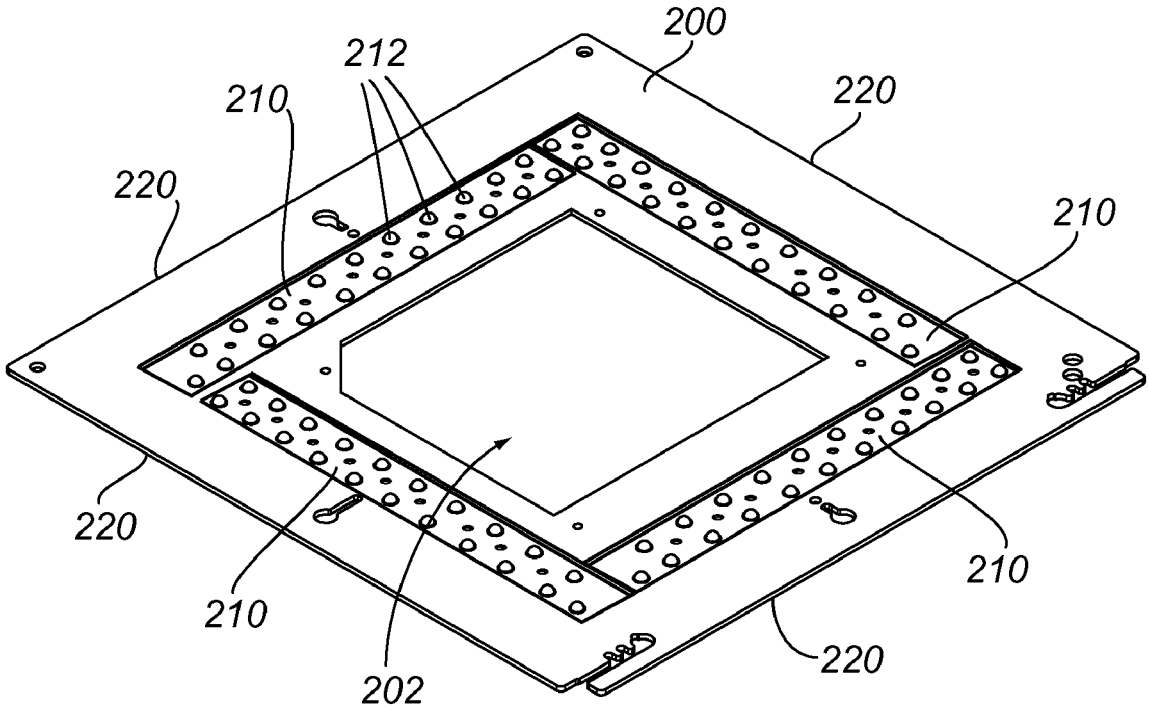
FIG. 3 is a bottom isometric view of a mounting plate and a plurality of light engines according to the embodiment shown in FIG. 2.
Figure 5:
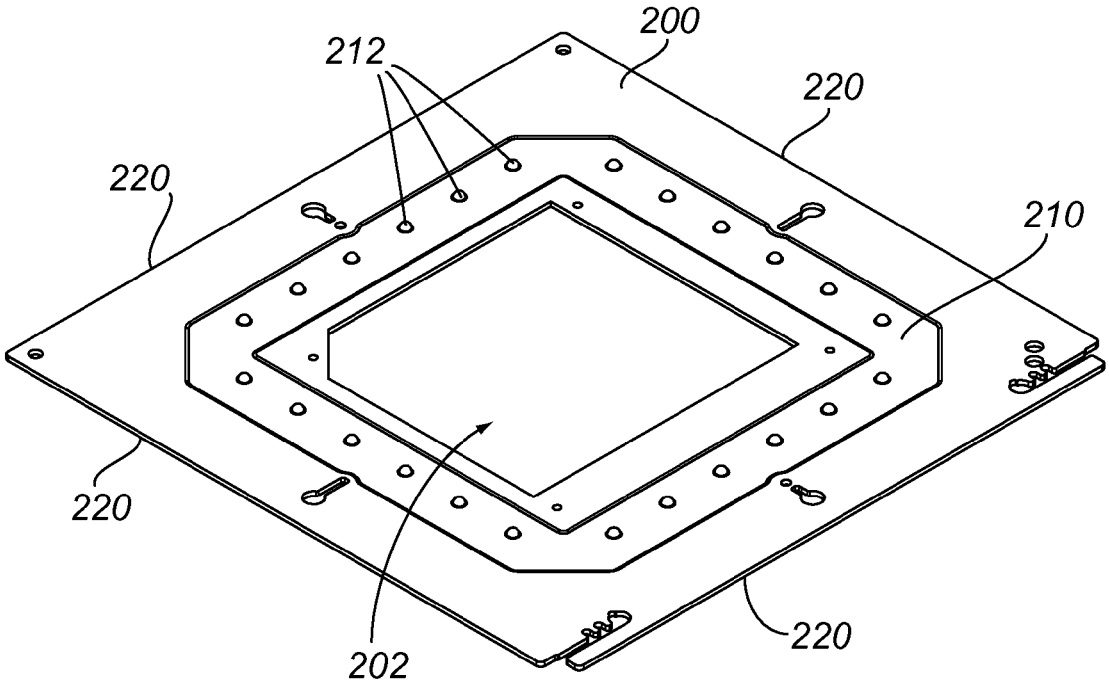
FIG. 5 is a bottom isometric view of a mounting plate and a light engine according to another embodiment of the light fixture.
Figure 6:
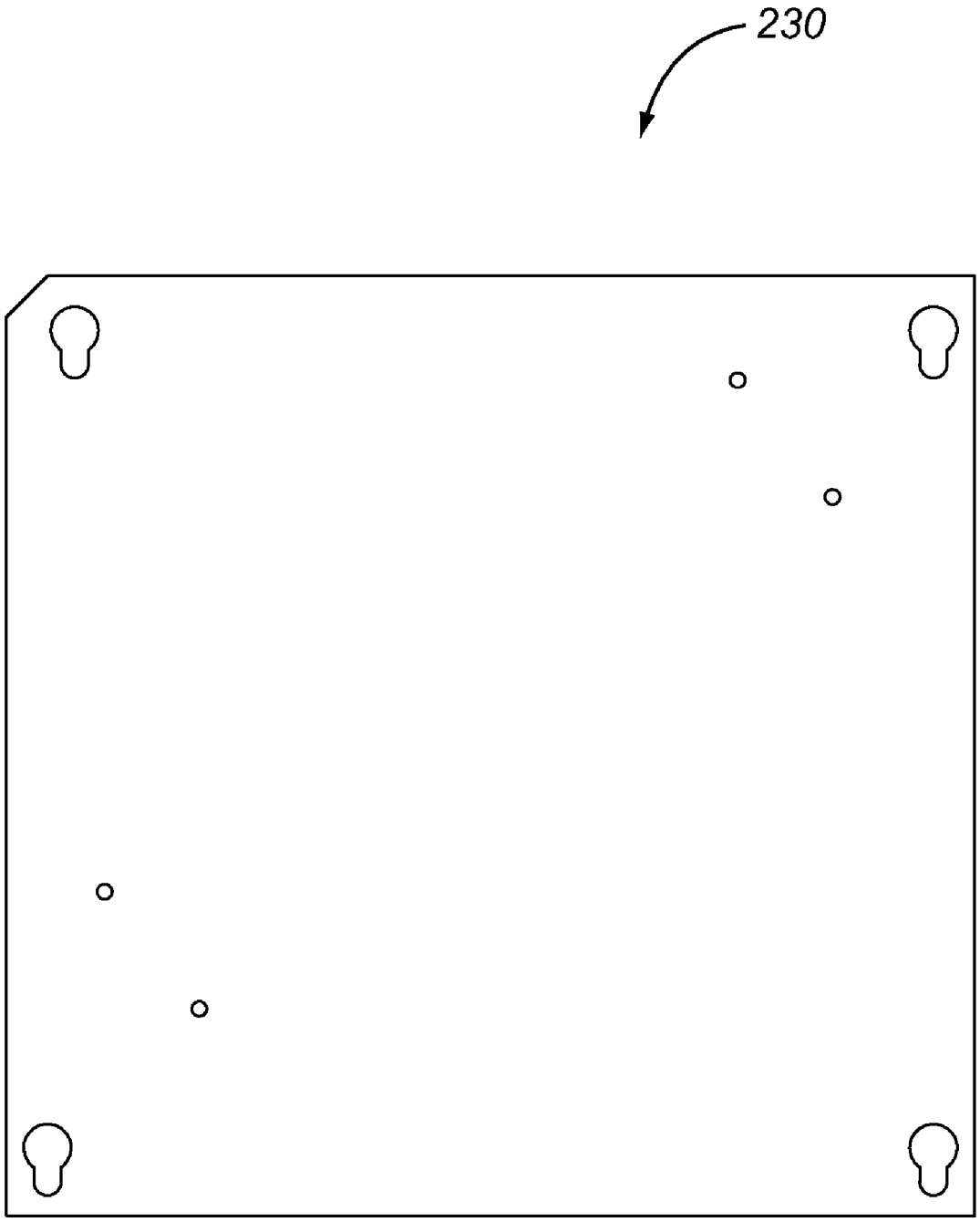
FIG. 6 is a top plan view of an access panel according to one embodiment.

In some embodiments, a mounting plate 200 is mounted to the bottom portion 122 of the hood 120. As shown in FIG. 7, the bottom portion 122 may include a lip 126 that surrounds the mounting plate 200, and the mounting plate 200 may be mounted within the lip 126 so as to be at least partially recessed within the underside of the hood 120. As shown in FIGS. 3 and 5, the mounting plate 200 may include an aperture 202 that allows access inside the hood 120 (as further discussed below). The mounting plate 200 may also include other apertures and cut-outs that are configured to affix the mounting plate 200 to the bottom portion 122 of the hood 120. In certain embodiments, the mounting plate 200 may be dimensioned to fit within the hood 16 of an existing post top fixture 10 (as shown in FIG. 1). Although the shape of the mounting plate 200 and the aperture 202 are square, the shapes are in no way so limited but rather can be any shape.

The mounting plate 200 may serve as a mount for light engines 210 with associated light sources 212 and as a heat transfer medium by which heat generated by the light sources 212 is dissipated to the hood 120. To most effectively serve this latter purpose, the mounting plate 200 is preferably made of a thermally conductive material, such as a metal. Any number of light engines 210 may be mounted in any arrangement on a mounting plate 200. There may be a plurality of light engines 210, or only a single light engine. In the embodiment shown in FIG. 3, a plurality of light engines 210 are mounted onto the mounting plate 200 around aperture 202 to form a square shape on the mounting plate 200. In FIG. 5, a single, square-shaped light engine 210 formed of four integral sides is mounted on the mounting plate 200. In either embodiment, it may be preferable to position the light engine(s) 210 and light sources 212 close to the outer edge 220 of the mounting plate 200 to reduce the heat path and improve the heat flow to the hood 120 of the light fixture 100.

Other embodiments do not use a mounting plate 200; instead, the light engine(s) 210 are mounted directly to the bottom portion 122 of the hood 120. In such embodiments it may be desirable (but certainly not required) to use a light engine 210 that is square-shaped such as in FIG. 5, but with an extended surface area to more closely resemble the mounting plate 200. Thus, it should be understood that although one embodiment includes both a mounting plate 200 and light engines 210, in some embodiments it may be possible to use only the light engine(s) 210.

Figure 4A:
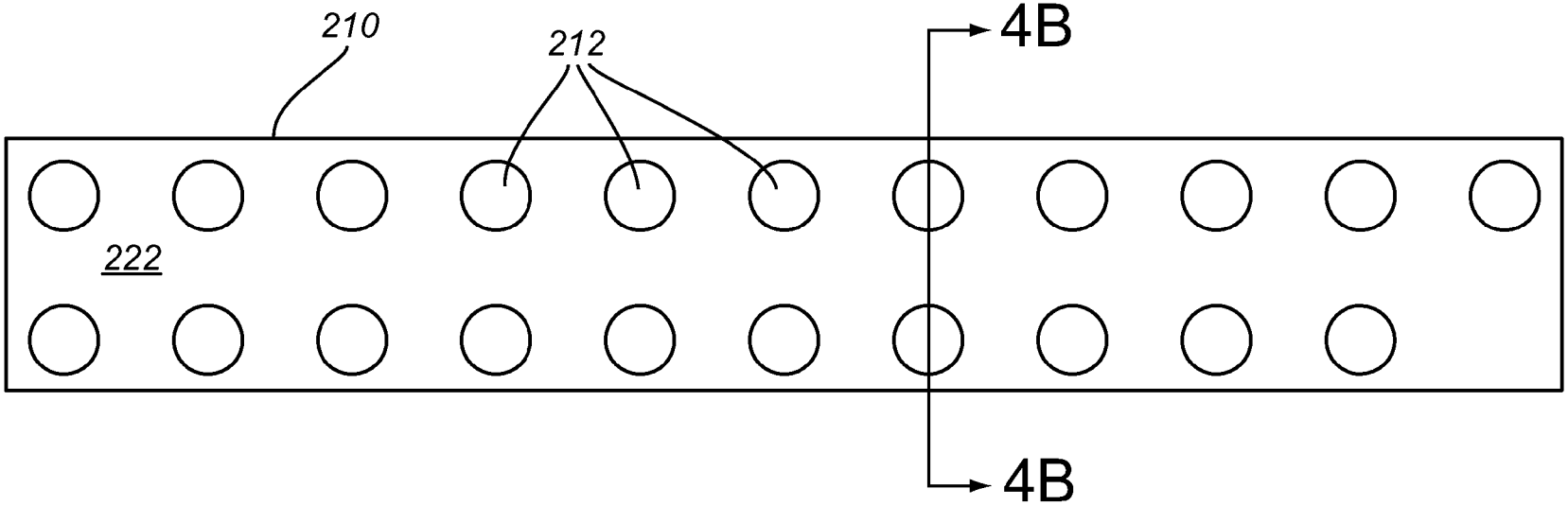
FIG. 4A is a top plan view of a light engine shown in FIG. 3.

The light engines 210 serve as a mount for a plurality of light sources 212. Any number of light sources 212 may be provided on the light engines 210 in any arrangement. The embodiment of a light engine 210 shown in FIGS. 4A and B includes twenty-one light sources 212 arranged in two linear rows. The embodiment of a light engine 210 shown in FIG. 5 only includes twenty-four light sources 212 (six per side of the light engine 210). Any number and arrangement of light sources 212 is contemplated herein.

Figure 4B:
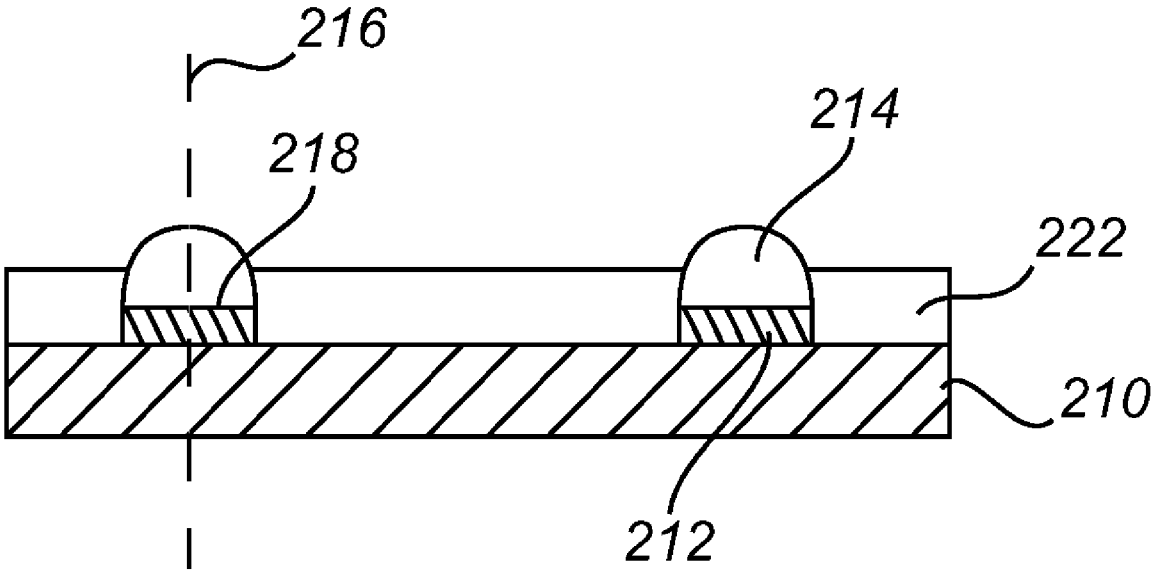
FIG. 4B is a cross-sectional view of the light engine of FIG. 4A taken along line 4B-4B.

The light source 212 may include, but is not limited to, a light-emitting diode (an "LED"). FIG. 4B shows a cross-sectional view of one light engine 210. The light source 212 includes a top surface 218 and an optical axis 216. Light is generally emitted from the light source 212 out of the top surface 218 and parallel to the optical axis 216. In the embodiment shown in FIG. 4B, there is a lens 214 mounted over the light source 212. The lens 214 is optional and may be configured to focus the light, or emit the light in a certain direction. In some embodiments the lens 214 may be rotatable with respect to the light source 212, thus allowing the lens 214 to be adjusted after installation. Although the lens 214 shown in FIG. 4B is symmetrical about the optical axis 216, in other embodiments the lens 214 may be asymmetrical in order to emit light in a particular direction.

In embodiments that do not have panes in the carriage 130, the light engines 210 are exposed to weather and the elements. Thus, it may be desirable to provide a light engine 210 that is weather resistant. This may be accomplished by sealing the light engine 210 with a protective layer 222 as illustrated in FIG. 4B. The protective layer 222 covers at least the light source 212, but may leave at least a portion of the lens 214 exposed in order to maintain optical efficiency. The protective layer 222 may be composed of silicone, rubber, or any other water-resistant material. In some embodiments the light engines 210 may be purchased as a single sealed unit. In other embodiments it may be necessary to manufacture a sealed light engine 210.

The light sources 212 emit both light and heat energy. The light sources 212 may become very hot, and thus, it may be desirable to conduct heat away from the light sources 212. It is preferable, but not necessary, that the light sources 212 be positioned on the mounting plate 200 close to the outer edge 220 of the mounting plate 200. In this way, heat generated by the light sources 212 is conducted away from the light sources 212 through the mounting plate 200 and to the hood 120 for dissipation from the light fixture. To facilitate such heat transfer to the hood 120, it may be desirable to provide a thermally conductive material between the bottom portion 122 of the hood 120 and the mounting plate 200 (if a mounting plate 200 is used) or the light engines 210.

All necessary power source(s) and wiring (not shown) needed for the light sources 212 may be positioned in a cavity 232 defined within the hood 120. FIG. 7 illustrates how to gain access to this cavity 232. The hood 120 may be opened along the edge 124, which contains a hinge. Then an access panel 230, which covers the aperture 202 defined by the mounting plate 200, may be removed. The access panel 230 may be pivotably attached or removably mounted to the mounting plate 200 through a slot and tab configuration or through other such mechanical fastening methods. Thus, as shown in FIG. 7, the access panel 230 may be removed to allow access to the cavity 232, which may optionally house a power source and wiring (not shown). Alternatively or in addition to the use of cavity 232 in hood 120, a similar cavity and access panel could be envisaged in the second end 140 of the carriage to house the power source(s) and wiring.

The configuration of the light fixture 100 both maximizes the light emitted into the intended area, and minimizes the light emitted in an upward direction (that is, towards the hood 120). Light is generally emitted parallel to the optical axis 216 of the light source 212 (shown in FIG. 4B). Thus, because the light engines 210 are mounted such that the light sources 212 extend downwardly, light is emitted downward into the intended area. No light is emitted from the light sources upwardly. The light sources 212 are preferably positioned on the light engines 210 and the light engines 210 are preferably positioned on the hood 120 so that light emitted from the light sources 212 has an unobstructed path to the intended area. It is preferable, but not required, that the second end 140 of the carriage 130 be shaped and sized so that it does not interfere with emission of the light to the intended area. For example, in the illustrated embodiments, the second end 140 of the carriage 130 has a smaller cross-sectional area than the first end 138 of the carriage 130 and substantially aligns with the aperture provided in the mounting plate 200 or defined by the light engine(s) 210 so as not to obstruct the downwardly directed light emitted from the light sources 212.

While not required, provision of lip 126 along the bottom portion 122 of the hood 120 prevents light emitted by the light sources 212 from escaping upwardly from the fixture. The depth of the lip 126 and the depth at which mounting plates 200 are recessed within hood 120 may be adjusted to control such upward emission. Thus, light pollution is minimized, as in line with several Dark Sky initiatives. Manufacturing expenses and time are reduced because there is no need to provide reflectors of other structures that result in indirect lighting. The configuration of light fixtures 100 according to this invention produces a higher lumen per watt than traditional light fixtures.

One of skill in the art would understand how to modify an existing post top fixture 10 to create the light fixture 100 described herein. For example, the light source 12 may be removed from the cavity 14. A mounting plate 200 with associated light engine(s) 210 as described herein could be mounted onto the hood 16. Any desired power source or wiring (not shown) could be stored in the cavity 14. If desired, the panes 26 could be removed to increase optical efficiency. Thus, modifying an existing post top fixture 10 may also result in a light fixture 100 as described herein. Manufacturing expenses and waste are reduced by modifying existing post top fixtures 10.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

The invention claimed is:

1. A light fixture comprising:

a. a carriage having a first end and a second end opposite the first end and each having a cross-sectional area, wherein the cross-sectional area of the first end is larger than the cross-sectional area of the second end;

b. a hood coupled to the first end of the carriage, the hood comprising a bottom portion;

c. a mounting plate mounted to the bottom portion of the hood, wherein the mounting plate defines an aperture extending through the mounting plate to permit access into a cavity located between the hood and the mounting plate;

d. an access panel that at least partially extends over the aperture to enclose the cavity; and e. a plurality of light engines mounted on the mounting plate, wherein:

i. each light engine comprises a plurality of light-emitting diodes;

ii. when the plurality of light engines are mounted to the mounting plate, the light-emitting diodes emit light substantially downwardly from the hood; and iii. the emitted light is substantially unobstructed by the second end of the carriage.

2. The light fixture as in claim 1, wherein the hood is coupled to the first end of the carriage by at least one of a hinged edge or removeable fasteners.

3. The light fixture as in claim 1, wherein the mounting plate comprises at least one outer edge and wherein at least some of the plurality of light sources are positioned on the mounting plate proximate to the at least one outer edge.

4. The light fixture as in claim 1, wherein at least one of the plurality of light-emitting diodes comprises a rotatable lens attached to the light-emitting diode.

5. The light fixture as in claim 1, wherein the plurality of light-emitting diodes on at least one of the plurality of light engines are mounted on the at least one of the plurality of light engines in at least one substantially straight row.

6. The light fixture as in claim 1, wherein at least some of the plurality of light engines are mounted on the mounting plate in a generally square-shaped configuration.

7. The light fixture as in claim 1, further comprising a thermally conductive material positioned between the mounting plate and the hood.

8. The light fixture as in claim 1, wherein the mounting plate comprises metal.

9. The light fixture as in claim 1, wherein the second end of the carriage substantially aligns with the aperture.

10. The light fixture as in claim 1, wherein the access panel is removable.

11. The light fixture as in claim 1, wherein the second end of the carriage comprises a pole receiving portion.

12. The light fixture as in claim 1, wherein the hood further comprises a lip that extends at least partially around the bottom portion of the hood to form a recess and wherein the mounting plate is affixed in the recess.

13. The light fixture as in claim 1, wherein the aperture is substantially square-shaped.

14. A method of modifying a post top fixture, wherein the post top fixture comprises:

a carriage having a first end and a second end opposite the first end and each having a cross-sectional area, wherein the cross-sectional area of the first end is larger than the cross-sectional area of the second end;

a hood coupled to the first end of the carriage, the hood comprising a bottom portion; and an existing light source mounted at least partially within the cavity, wherein the method for modifying a post top fixture comprises:

removing the existing light source;

affixing a mounting plate to the bottom portion of the hood, wherein the mounting plate defines an aperture that extends through the mounting plate to permit access into a cavity located between the hood and the mounting plate, wherein the mounting plate comprises at least one light engine mounted thereon, and wherein:

i. the at least one light engine comprises a plurality of light-emitting diodes;

ii. when the mounting plate is mounted to the bottom portion of the hood, the light-emitting diodes emit light substantially downwardly from the hood; and iii. the emitted light is substantially unobstructed by the second end of the carriage.

15. The method as in claim 14, wherein the post top fixture further comprises at least one pane extending between the first and second ends of the carriage, and the method further comprises removing the at least one pane.

16. The method as in claim 14, further comprising installing a power source inside the cavity.

17. The method as in claim 16, further comprising positioning an access panel over the aperture in the mounting plate to enclose the cavity.

* * * * *